US007105034B2

(12) United States Patent
Jung et al.

(10) Patent No.: US 7,105,034 B2
(45) Date of Patent: Sep. 12, 2006

(54) CYCLONE-TYPE DUST COLLECTING APPARATUS FOR VACUUM CLEANER

(75) Inventors: Il-Du Jung, Gwangju (KR); Jang-Keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 449 days.

(21) Appl. No.: 10/620,723

(22) Filed: Jul. 16, 2003

(65) Prior Publication Data

US 2004/0211025 A1 Oct. 28, 2004

(30) Foreign Application Priority Data

Apr. 28, 2003 (KR) ..... 10-2003-0026644

(51) Int. Cl.
*B01D 45/12* (2006.01)
*B01D 50/00* (2006.01)

(52) U.S. Cl. ..... 55/337; 55/426; 55/429; 55/459.1; 55/481; 55/DIG. 3; 15/350; 15/353

(58) Field of Classification Search ..... 55/337, 55/424, 426, 429, 459.1, 481, DIG. 3; 15/350, 15/353

See application file for complete search history.

(56) References Cited

U.S. PATENT DOCUMENTS

| | | | | |
|---|---|---|---|---|
| 3,412,529 | A * | 11/1968 | Tailor | 95/213 |
| 6,042,628 | A | 3/2000 | Nishikiori | 55/337 |
| 6,090,184 | A | 7/2000 | Cartellone | 95/69 |
| 6,406,505 | B1 | 6/2002 | Oh et al. | 55/337 |
| 6,532,620 | B1 | 3/2003 | Oh | 15/353 |
| 6,810,557 | B1 * | 11/2004 | Hansen et al. | 15/353 |
| 2002/0011053 | A1 | 1/2002 | Oh | 55/426 |
| 2002/0046438 | A1 | 4/2002 | Oh | 15/353 |
| 2002/0069476 | A1 | 6/2002 | Yung | 15/352 |
| 2003/0019074 | A1 | 1/2003 | Oh et al. | 15/352 |

FOREIGN PATENT DOCUMENTS

| | | |
|---|---|---|
| DE | 19938769 | 8/1999 |
| DE | 199 38 769 | 3/2001 |
| DE | 10056935 A1 | 2/2002 |
| EP | 0679364 A1 | 2/1995 |
| GB | 2365324 | 10/2000 |

(Continued)

OTHER PUBLICATIONS

Search Report based on British Patent Application No. 040088834 issued on Jul. 15, 2004 and filed on Jan. 15, 2004.

(Continued)

*Primary Examiner*—Robert A. Hopkins
(74) *Attorney, Agent, or Firm*—Ohlandt, Greeley, Ruggiero & Perle, L.L.P.

(57) ABSTRACT

Disclosed is a cyclone-type dust collecting apparatus for a vacuum cleaner, that includes a cyclone body having an air inlet port and an air outlet port, for forming a vortex current of air which is introduced through the air inlet port and contains dust, a dust collecting container removably coupled to the cyclone body so as to collect the dust separated by centrifugal force of the vortex current in the cyclone body, a double grill assembly disposed at an upstream portion of the air outlet port in the cyclone body to prevent the air from flowing back through the air outlet port, and having a dual structure having an outer grill and an inner grill, and a fine dust collecting means disposed at a downstream portion of the double grill assembly in the cyclone body to collect fine dust which is not removed by the double grill assembly.

28 Claims, 10 Drawing Sheets

FOREIGN PATENT DOCUMENTS

| | | | |
|---|---|---|---|
| GB | 2368005 | | 2/2001 |
| GB | 2 370 978 | | 7/2001 |
| GB | 2377656 | | 11/2001 |
| GB | 2381223 | | 8/2002 |
| GB | 2 377 881 | | 11/2003 |
| WO | 200160226 | | 8/2001 |
| WO | WO 02/078505 | | 10/2002 |
| WO | WO 02/078506 | | 10/2002 |
| WO | WO02078505 | A2 | 10/2002 |
| WO | WO02078505 | A3 | 10/2002 |
| WO | WO02078506 | A1 | 10/2002 |

OTHER PUBLICATIONS

Office Action of the German Patent and Trademark Office, dated Feb. 20, 2004.

Search Report based on Russian Official Action No. 2003124585 filed on Oct. 19, 2004.

Copy of Preliminary Search Report based on corresponding application No. 0308970 by the French Patent Office, dated Nov. 25, 2004.

Spanish Patent Office State of Art dated Sep. 22, 2005 in connection with corresponding Application No. 200302348.

* cited by examiner

CYCLONE-TYPE DUST COLLECTING APPARATUS FOR VACUUM CLEANER

BACKGROUND OF THE INVENTION

1. Field of the Invention

The present invention relates to a dust collecting apparatus, and more particularly, to a cyclone-type dust collecting apparatus for a vacuum cleaner, which allows air containing various dusts and foreign substances (hereinafter, called "dust") to form a vortex current, thereby collecting the dust from the vortex current of air by centrifugal force.

2. Description of the Related Art

FIGS. 1 and 2 show a schematic example of a typical cyclone-type dust collecting apparatus for a vacuum cleaner.

As shown in FIGS. 1 and 2, the cyclone-type dust collecting apparatus 100 for the vacuum cleaner generally comprises a cyclone body 10, a dust collecting container 20 and a grill 30.

The cyclone body 10 is provided with an air inlet port 11 and an air outlet port 12. The air inlet port 11 is formed at a side of the cyclone body 10 in a tangential direction, and the air outlet port 12 is formed at a center portion of an upper face of the cyclone body 10. Herein, when the cyclone-type dust collecting apparatus 100 is disposed in a dust chamber 230, the air inlet port 11 is connected to an air inlet path 210 which is disposed at a main body 200 of the vacuum cleaner so that an end of the air inlet path 210 is exposed to the dust chamber 230, and the air outlet port 12 is connected to an air outlet path 220 of the main body 200 of the vacuum cleaner. Therefore, the air introduced through a suction brush 300 and containing the dust is introduced through the air inlet path 210 of the main body 200 of the vacuum cleaner and the air inlet port 11 into the cyclone body 10 in the tangential direction. Thus, a vortex current of air is formed in the cyclone body 10, and the dust contained in the vortex current is separated by centrifugal force, and then the purified air is exhausted through the air outlet port 12, the air outlet path 220 of the main body 200 of the vacuum cleaner and a motor driving chamber 310.

The dust collecting container 20 is removably coupled to a lower portion of the cyclone body 10 so as to collect the dust separated from the air by the vortex current.

The grill 30 is disposed at an upstream portion of the air outlet port 12 in the cyclone body 10 so that the dust separated from the vortex current dose not flow backward through the air outlet port 12. The grill 30 is provided with a grill body 31 and a plurality of paths 32 formed at an outer surface of the grill body so as to be fluidly communicated with the air outlet port 12. Further, the grill 30 has a dust preventing member 33 disposed at a lower portion of the grill body 31.

The conventional cyclone-type dust collecting apparatus as described above is mounted in the dust chamber 230 of the main body 200 of the vacuum cleaner so that the air inlet port 11 and the air outlet port 12 of the cyclone body 10 are connected to the air inlet path 210 and the air outlet path 220 of the main body 200 of the vacuum cleaner.

When starting a cleaning operation, a suction force is generated at the suction brush 300 due to driving of a motor in the motor driving chamber 310. Then, the air containing the dust on a surface of an object to be cleaned is introduced through the suction brush 300, the air inlet path 210 and the air inlet port 11 into the cyclone body 10 due to the suction force. At this time, the introduced air is induced from the air inlet port 11 along an internal interference of the cyclone body 10 in an oblique direction, thereby forming the vortex current of air. Therefore, the dust contained in the air is separated by the centrifugal force and collected in the dust collecting container 20. Then, the purified air is exhausted through the path 32 of the grill 30, the air outlet port 12, the air outlet path 220 and the motor driving chamber 310 to the outside.

In the above mentioned cyclone-type dust collecting apparatus, the collecting and the preventing of the backflow of the dust separated from the vortex current are important factors that have great influence on a collecting efficiency. Therefore, there have been steady attempts and studies for efficiently collecting the dust and preventing of the backflow of the dust. However, it reaches a limit of the development due to a structure of the cyclone-type dust collecting apparatus.

That is, since the conventional cyclone-type dust collecting apparatus has a structure in which the dust collected in the dust collecting container 20 is ascended upward by an ascending air current reflected by a bottom surface of the dust collecting container 20, there are some problems that the collecting operation of the dust is inefficiently performed and also fine dust out of the ascending dust, which is smaller than a size of the path 32 of the grill 30, is exhausted through the path 32 of the grill 30 to the outside, thereby deteriorating the dust collecting efficiency.

SUMMARY OF THE INVENTION

Therefore, it is one aspect of the present invention to provide a cyclone-type dust collecting apparatus for a vacuum cleaner, which can prevent the ascending of the dust collected in the dust collecting container and also collect the fine dust contained in the air, thereby reducing the backflow of the fine dust and thus increasing the dust collecting efficiency.

It is other aspect of the present invention to provide a vacuum cleaner with a cyclone-type dust collecting apparatus having the above-mentioned characteristic.

To achieve the above aspects and/or other advantages and features of the present invention, there is provided a cyclone-type dust collecting apparatus for a vacuum cleaner including a cyclone body having an air inlet port and an air outlet port, for forming a vortex current of air which is introduced through the air inlet port and contains dust, a dust collecting container removably coupled to the cyclone body so as to collect the dust separated by centrifugal force of the vortex current in the cyclone body, a double grill assembly disposed at an upstream portion of the air outlet port in the cyclone body to prevent the air from flowing back through the air outlet port, and having a dual structure comprising an outer grill and an inner grill, and a fine dust collecting means disposed at a downstream portion of the double grill assembly in the cyclone body to collect fine dust which is not removed by the double grill assembly.

Preferably, the cyclone body comprises a vortex current chamber member that the air inlet port is formed at an outer surface thereof and a communicating hole is formed at an upper surface thereof, and a pressure drop chamber member coupled to the vortex current chamber member to be in fluid communication through the communicating hole and having the air outlet port at an outer surface thereof, and the double grill assembly is disposed at the vortex current chamber member, and fine dust collecting means is disposed at the pressure drop chamber member.

Further, the pressure drop chamber member comprises a path forming member partitioning an inner space of the pressure drop chamber member into a first space fluidly communicated with the communicating hole and a second space fluidly communicated with the air outlet port, so that the air containing the fine dust passing through the double grill assembly is flown from the upstream portion toward the downstream portion of the fine dust collecting means and exhausted through the air outlet port.

The fine dust collecting means comprises a filter mounting portion formed at an upper side of the path forming member and having a front opening and a plurality of upper and lower through holes for fluidly communicating the air outlet guiding path and the air outlet port, and a filter assembly detachably coupled to the filter mounting portion in a drawer way.

The filter assembly comprises a filter case having a shape corresponding to a size and a structure of the filter mounting portion, and a fine filter disposed at the filter case.

The fine filter is formed of sponge, and the apparatus further comprises a packing member disposed at a portion of the filter case, which is contacted with an edge of the front opening and a handle provided at a front face of the filter case.

Furthermore, the outer grill and the inner grill are respectively provided with a cylindrical grill body and a plurality paths formed at an outer surface of the cylindrical grill body to be fluidly communicated with the communicating hole, and a dust preventing member is disposed at a lower side of the inner grill.

The paths are defined by a plurality of path members which are disposed at an outer surface of the grill body at regular intervals to be inclined at a desired angle.

Preferably, the dust preventing member has a conical portion that is spread downward from a lower end of the grill body at a desired angle and a cylindrical portion that is extended downward from the conical portion at a desired distance, and the dust preventing member is integrally formed with the grill body.

The dust collecting container has a dual structure comprising an outer cylinder which has the same diameter as that of the cyclone body and an inner cylinder which has the same diameter as that of the outer grill, and thus is partitioned into a first dust collecting portion and a second dust collecting portion, and at least one dust outlet path for exhausting the dust of the first dust collecting portion to a second dust collecting portion is formed at a lower side of the inner cylinder.

According to the present invention, there is provided a vacuum cleaner, comprising a suction brush having a nozzle opened toward an surface to be cleaned and a motor driving chamber in which a motor for generating a suction force in the nozzle is mounted, a main body of the vacuum cleaner, which is rotatably connected to the suction brush and has an air outlet path and an air inlet path connected to the motor driving chamber, and a cyclone-type dust collecting apparatus removably disposed in a dust chamber of the main body, for separately collecting dust contained in air introduced through the nozzle of the suction brush, wherein the cyclone-type dust collecting apparatus comprises a cyclone body having an air inlet port connected to the air inlet path and an air outlet port connected to the air outlet path and forming a vortex current of the air containing the dust introduced through the air inlet port, a dust collecting container removably coupled to the cyclone body so as to collect the dust separated by centrifugal force of the vortex current in the cyclone body, a double grill assembly disposed at an upstream portion of the air outlet port in the cyclone body to prevent the air from flowing back through the air outlet port, and having a dual structure comprising an outer grill and an inner grill, and a fine dust collecting means disposed at a downstream portion of the double grill assembly in the cyclone body to collect fine dust which is not removed by the double grill assembly.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
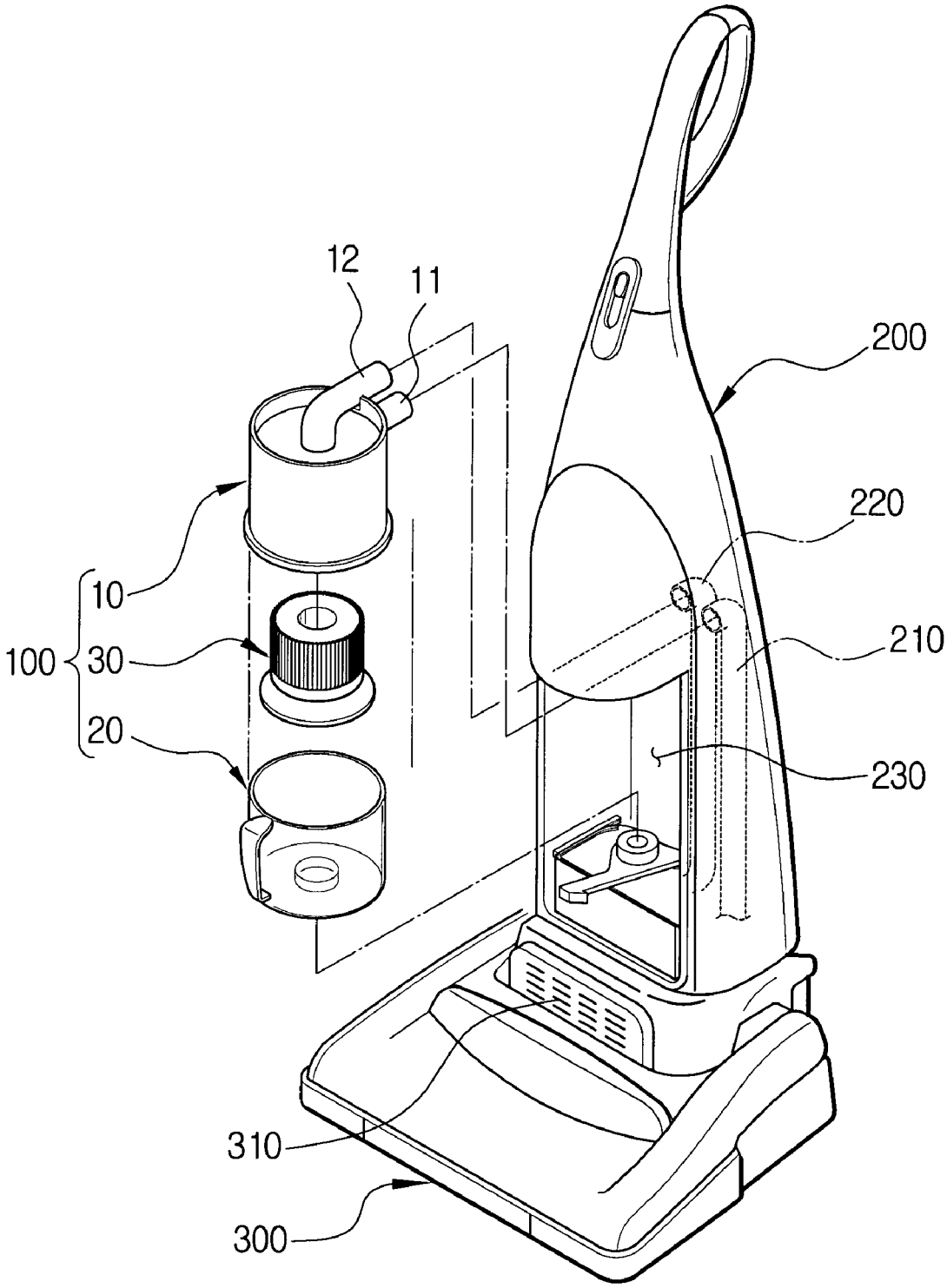
FIG. 1 (PRIOR ART)
FIG. 1 is a perspective view of a conventional cyclone-type dust collecting apparatus and a vacuum cleaner having the cyclone-type dust collecting apparatus.
Figure 2:
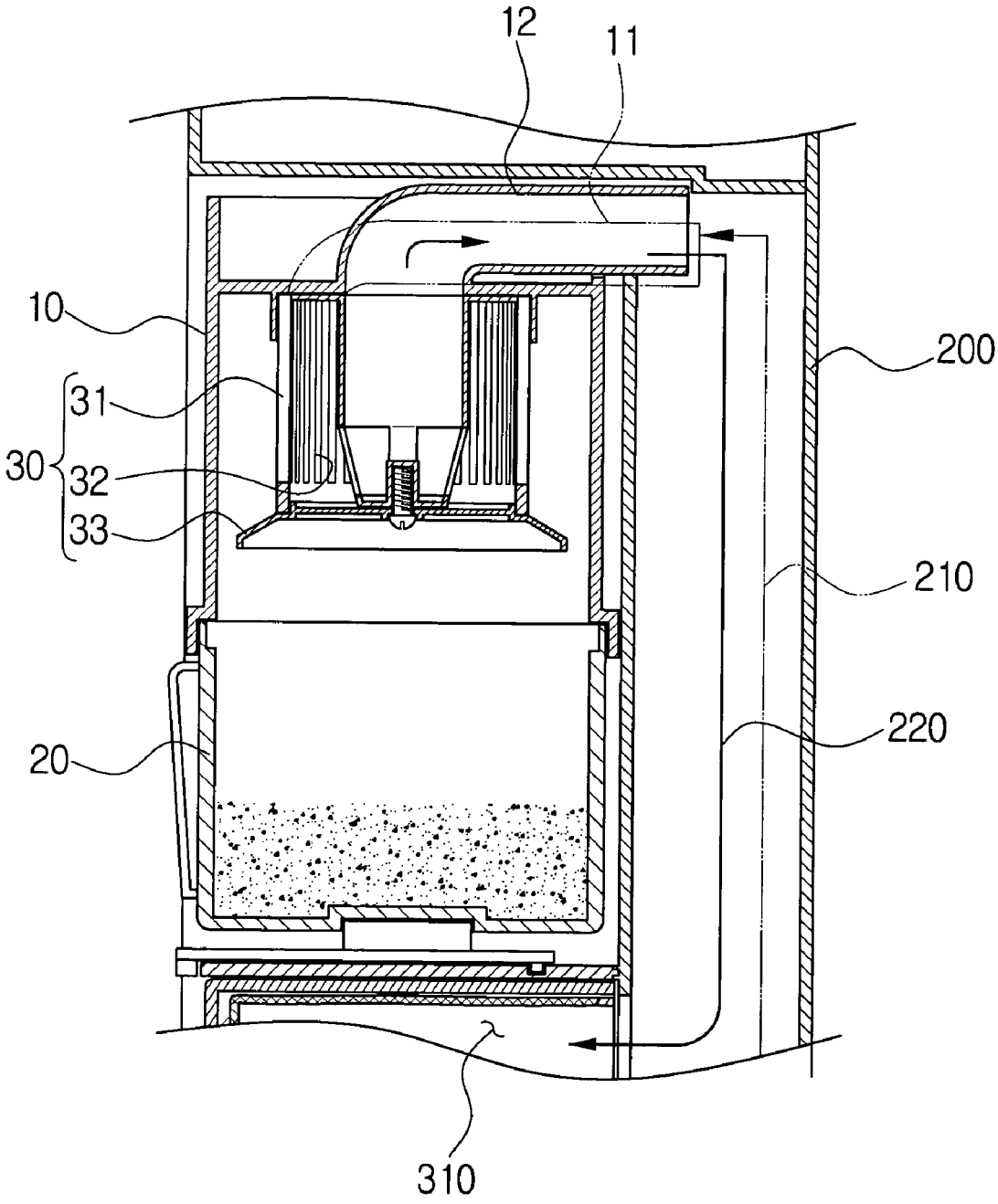
FIG. 2 (PRIOR ART)
FIG. 2 is a cross-sectional view showing a dust separating and collecting process of the conventional cyclone-type dust collecting apparatus of FIG. 1.
Figure 3:
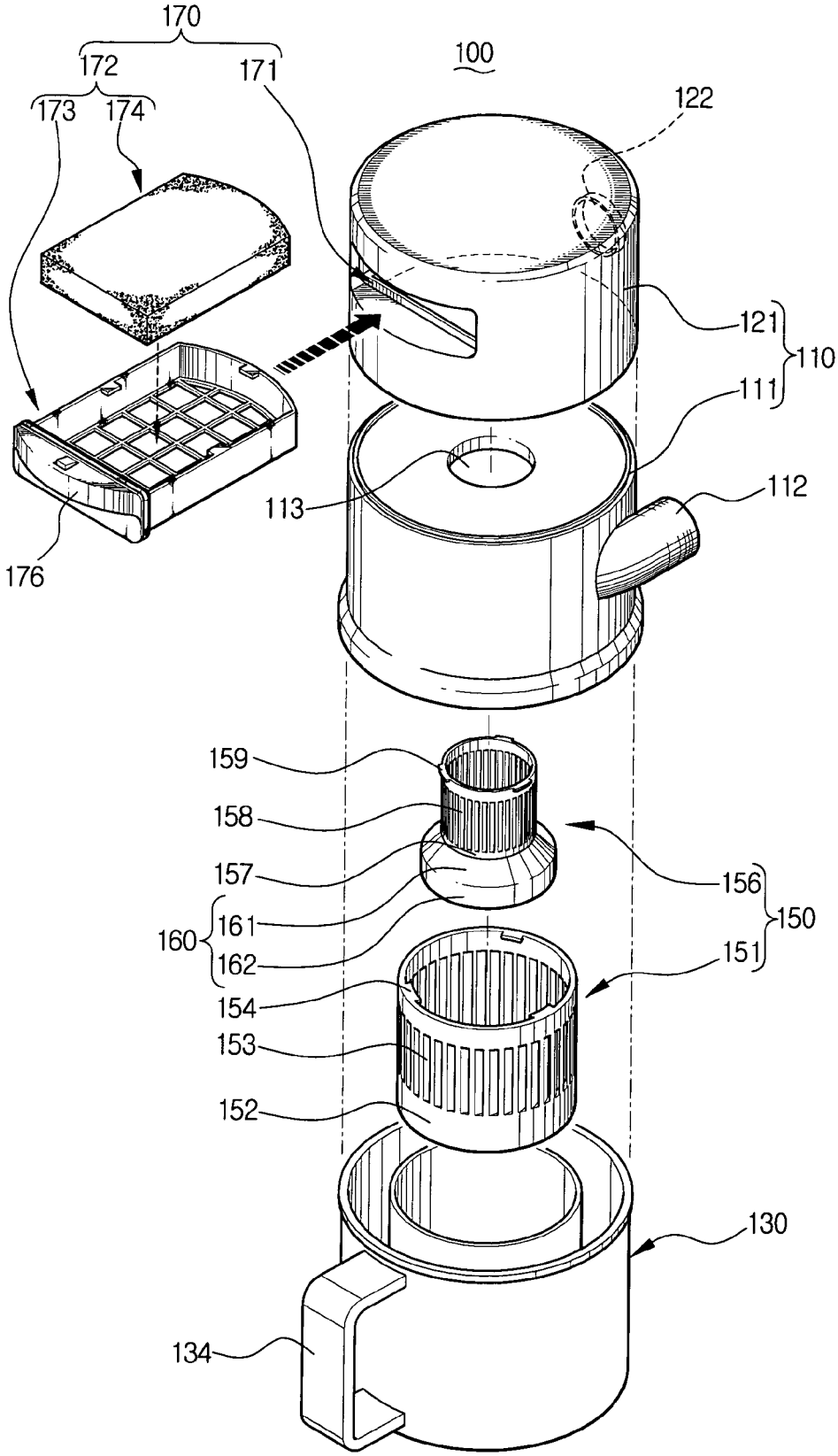
FIG. 3 is an exploded perspective view of a cyclone-type dust collecting apparatus for a vacuum cleaner according to an embodiment of the present invention.
Figure 4:
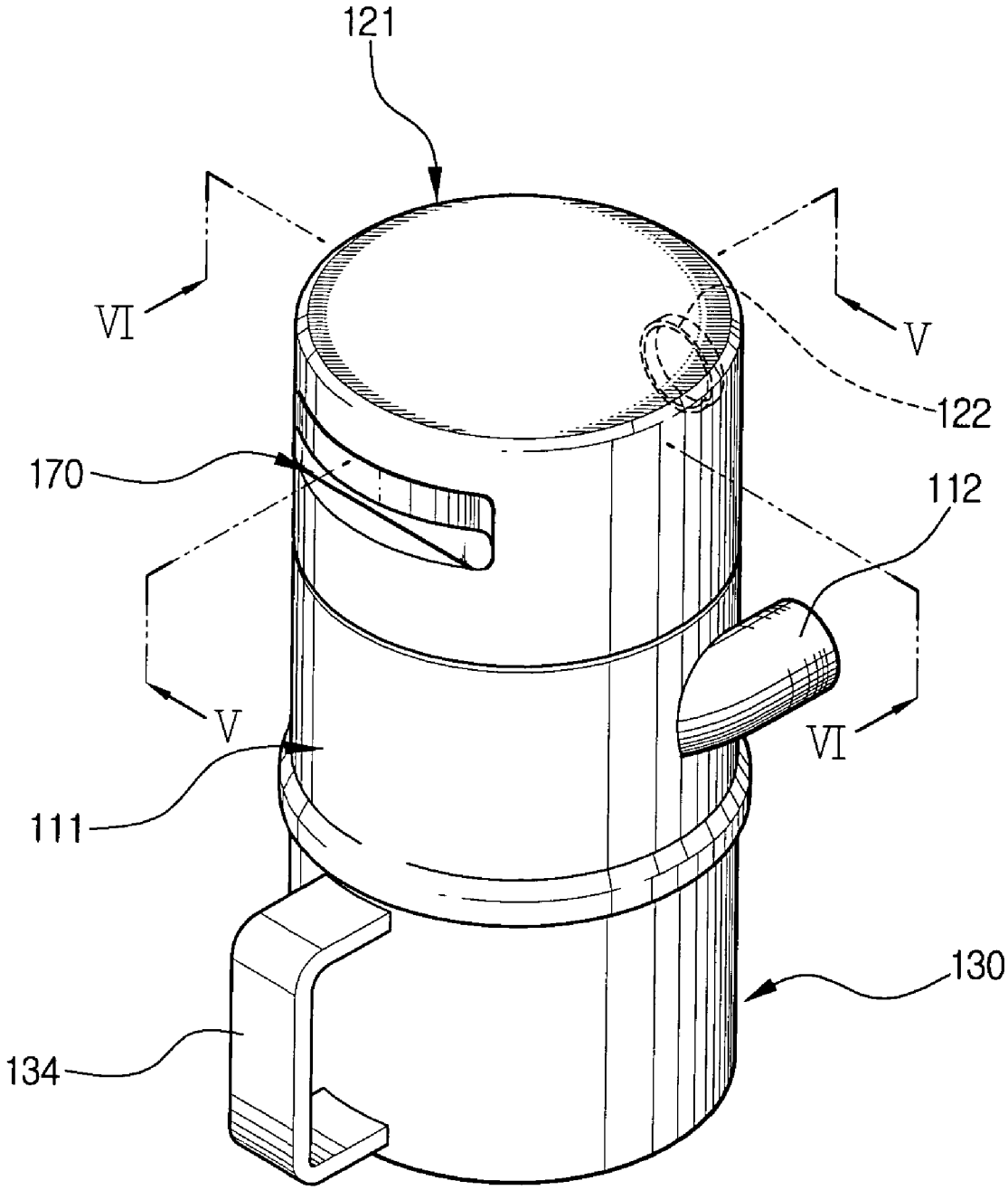
FIG. 4 is a perspective view showing an assembled state of FIG. 3.

Now, preferred embodiments of the present invention will be described in detail with reference to the annexed drawings.

As shown in FIGS. 3 to 6, a cyclone-type dust collecting apparatus 100 for a vacuum cleaner according to an embodiment of the present invention comprises a cyclone body 110, a dust collecting container 130, a double grill assembly 150 and a fine dust collecting means 170.

Figure 8:
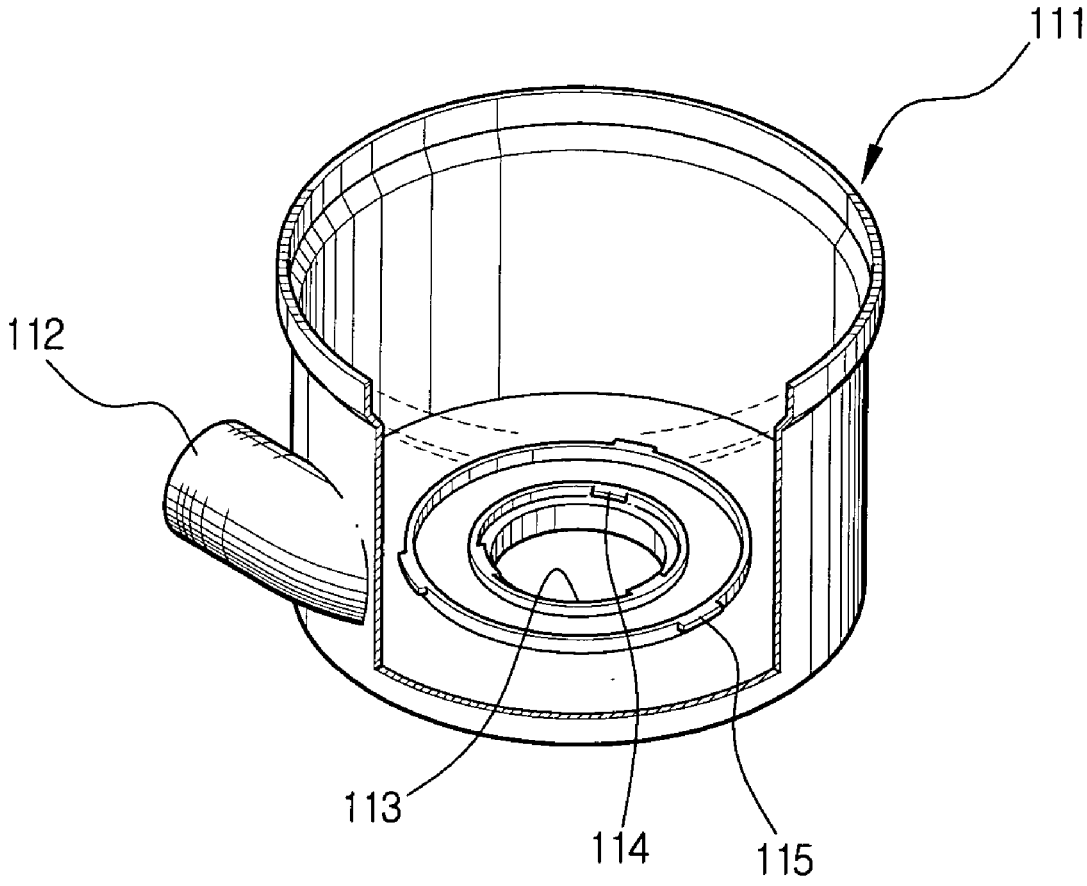

The cyclone body 110 is comprised of a vortex current chamber member 111 and a pressure drop chamber member 121 which are separated to each other. Alternatively, the vortex current chamber member 111 and the pressure drop chamber member 121 may be integrally formed. As shown in FIG. 8, the vortex current chamber member 111 has a cylindrical structure of which a lower side is opened. At an outer circumferential surface of the vortex current chamber member 111, there is formed an air inlet port 112. At a center portion of an upper surface, thereof is formed a communicating hole 113. The air inlet port 112 is formed in a tangential direction with respect to the outer circumferential surface. Therefore, the air introduced into the air inlet port 112 forms a vortex current in the vortex current chamber member 111. Furthermore, at a circumference of an inner portion of the vortex current chamber member 111, there are formed a plurality of inward latching portions 114 and outward latching portions 115 at regular intervals. A purpose of the latching portions 114 and 115 is to install the double grill assembly 150, and a more complete explanation will be given later on.

Figure 6:
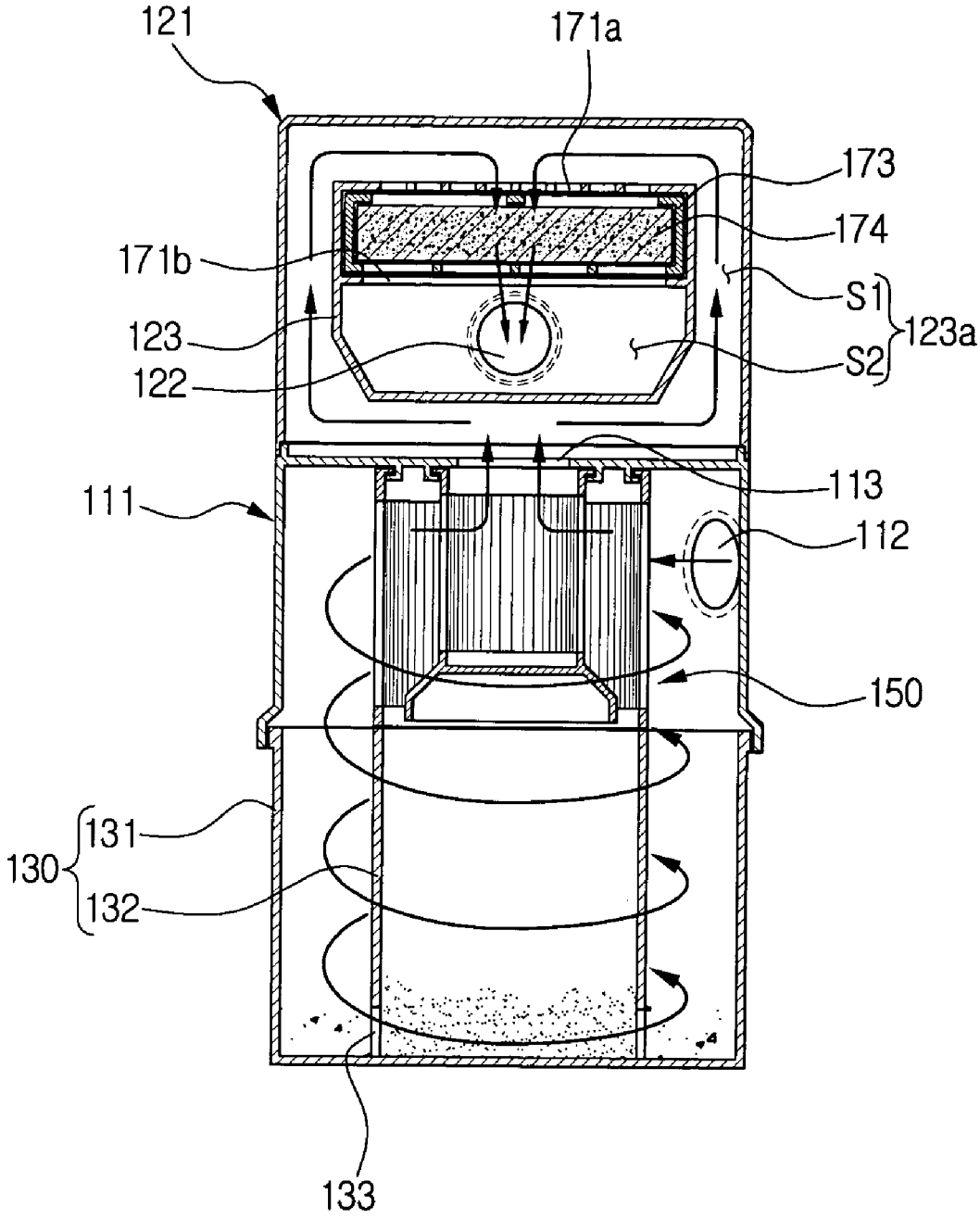
FIG. 6 is a cross-sectional view taken along a line VI—VI of FIG. 4.
Figure 7:
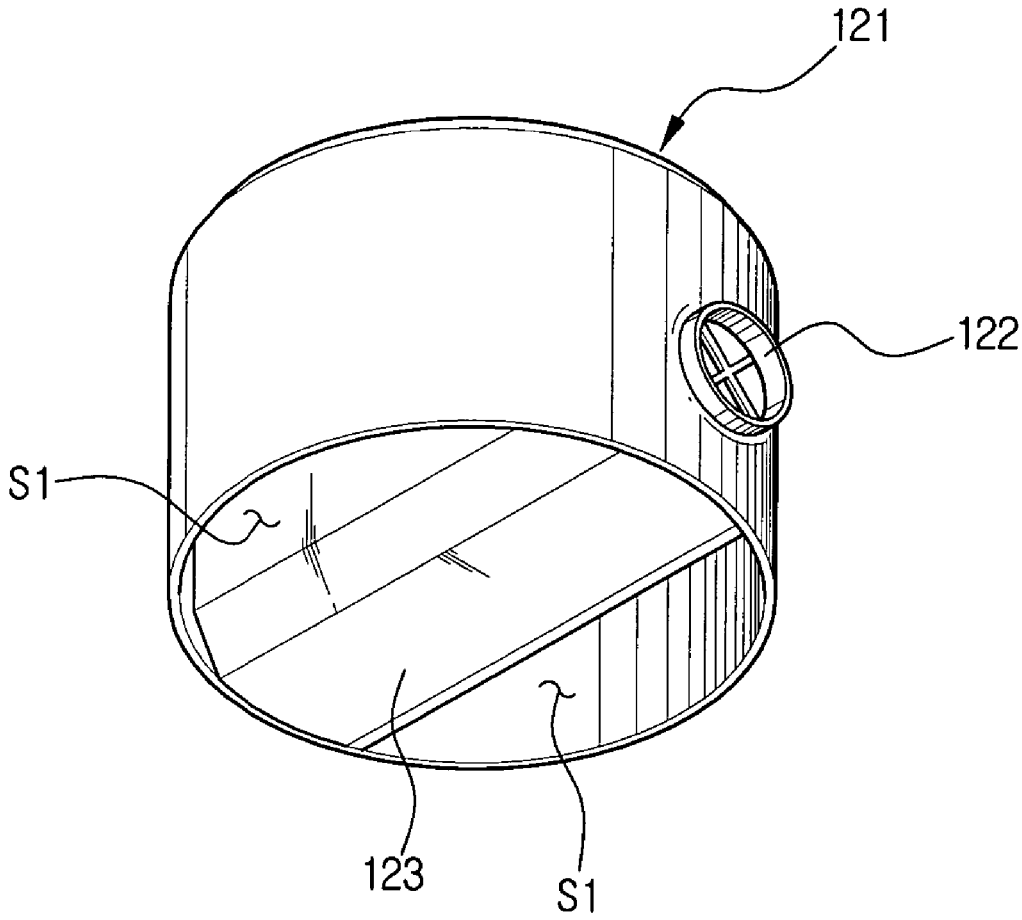
FIGS. 7 and 8 are perspective views showing a pressure drop chamber member and a vortex current chamber member constituting a cyclone body of the cyclone-type dust collecting apparatus according to the present invention.

As shown in FIG. 7, the pressure drop chamber member 121 has a cylindrical structure of which a lower side is opened. At an outer circumferential surface of the pressure drop chamber member 121, there is formed an air outlet port 122. Further, the pressure drop chamber member 121 has a path forming member 123 for partitioning a first space S1 fluidly communicated with the communicating hole 113 of the vortex current chamber member 111 and a second space S2 fluidly communicated with the air outlet port 122. Herein, the spaces S1 and S2 form an air outlet guiding path 123*a*. Thus, as shown by an arrow of FIGS. 5 and 6, the air is exhausted through the fine dust collecting means 170 to the air outlet port 122, as described below.

Figure 9:
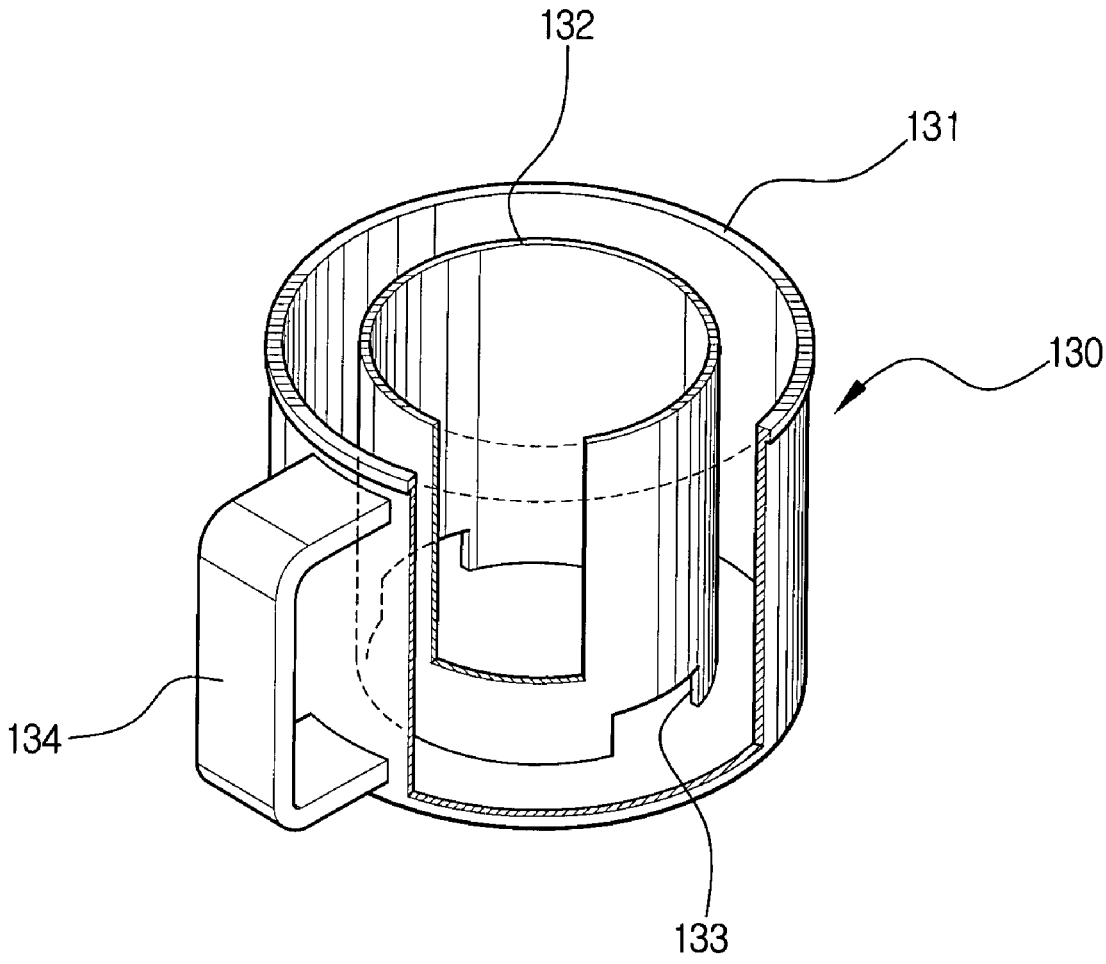
FIG. 9 is a perspective view of a dust collecting container of the cyclone-type dust collecting apparatus according to the present invention.

The dust collecting container 130 is removably coupled to a lower portion of the cyclone body 110, i.e., the vortex current chamber member 111, so as to collect the dust separated from the air by the centrifugal force of the vortex current. As shown in FIG. 9, the dust collecting container 130 has a dual structure comprising an outer cylinder 131 and an inner cylinder 132, and thus is partitioned into a first dust collecting portion C1 and a second dust collecting portion C2. The outer cylinder 131 is formed to have the same diameter as that of the vortex current chamber member 111, and the inner cylinder 132 is formed to have a smaller diameter than that of the outer cylinder 131. Preferably, the diameter of the inner cylinder 132 is the same as that of an outer grill 151 of the double 114 grill assembly 150, which will be described below. In addition, at a lower side of the inner cylinder 132, a pair of dust outlet paths 133 for exhausting the dust from the first dust collecting portion C1 to a second dust collecting portion C2 are formed to be opposite to each other. The outer cylinder 131 is formed with a handle 134. In the drawings, there is described the dust collecting container 130 having the pair of dust outlet paths 133. However, only a single or 3~4 dust outlet paths 133 may be formed.

The double impeller grill assembly 150 is disposed at an upstream portion of the air outlet port 122 in the cyclone body 110, more concretely, at a circumference of the communicating hole 113 of the vortex current chamber member 111 so as to prevent a backflow of the dust separated from the air through the air outlet port 122.

The double grill assembly 150 has a dual structure comprising an outer grill 151 and an inner grill 156 according to a characteristic of the present invention. The outer grill 151 has a cylindrical grill body 152 of which upper and lower portions are opened and which is formed with a plurality of paths 153 at an outer surface thereof. A plurality of first latching protrusions 154 formed at an inner portion of an upper end of the grill body 152 at regular intervals are coupled to the outward latching portions 115 formed at the circumference of the communicating hole 113 of the vortex current chamber member 111. The inner grill 156 has a cylindrical grill body 157 of which upper and lower portions are opened and which is formed with a plurality of paths 158 at an outer surface thereof. A plurality of second latching protrusions 159 formed at an outer portion of an upper end of the grill body 157 at regular intervals are coupled to the inward latching portions 114 formed at the circumference of the communicating hole 113 of the vortex current chamber member 111.

Figure 5:
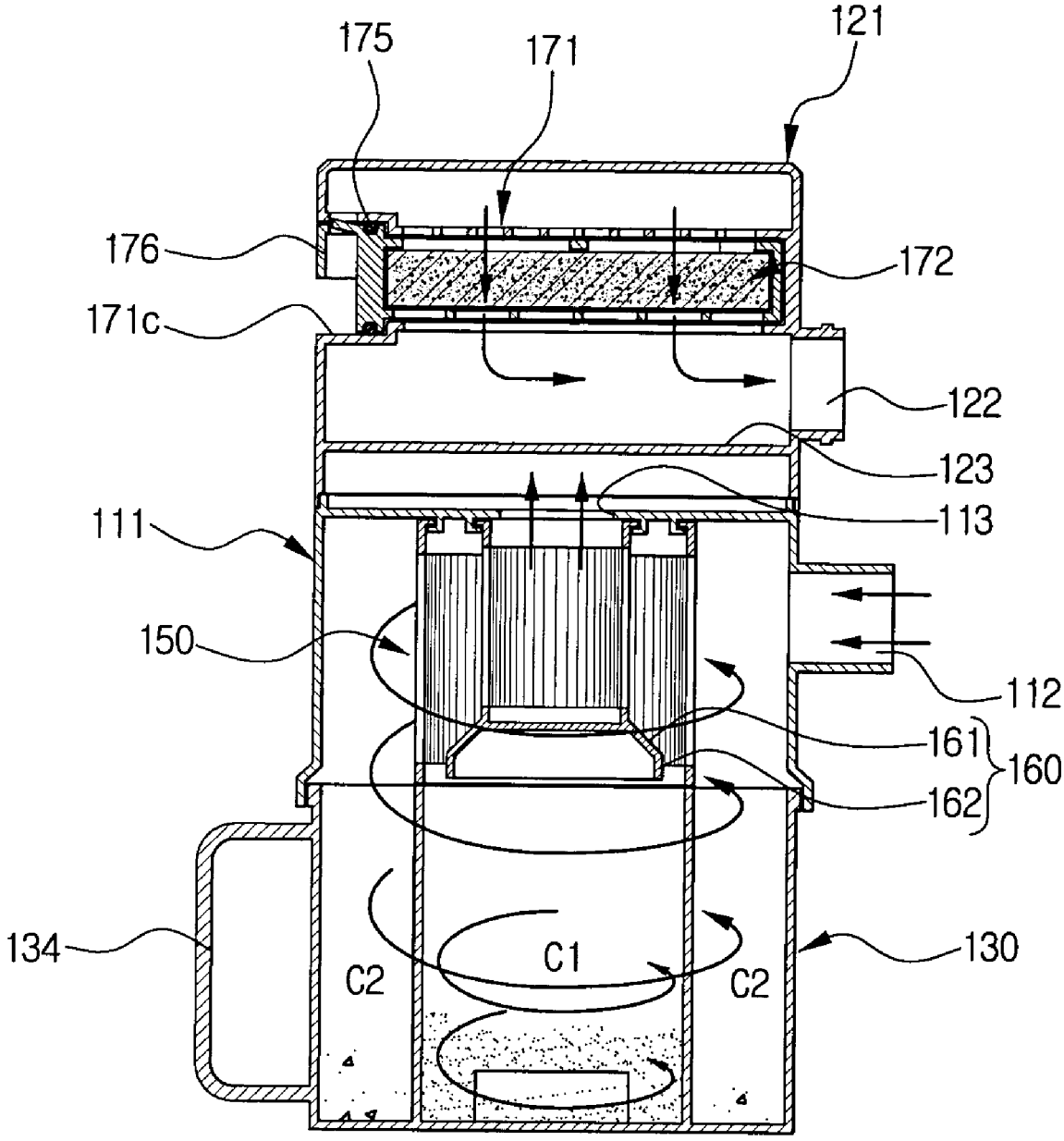
FIG. 5 is a cross-sectional view taken along a line V—V of FIG. 4.

Furthermore, the inner grill 156 is formed with a dust preventing member 160 which is disposed at a lower side of the grill body 157 so as to reflect the dust ascended in the dust collecting container 130 so that the dust is caught again into the vortex current of air. The dust preventing member 160 is not limited to a certain shape. However, as shown in FIGS. 5 and 6, it is effective in an aspect of the dust reflection to have a conical portion 161 that is spread downward from a lower end of the grill body 157 at a desired angle and a cylindrical portion 162 that is extended downward from the conical portion 161 at a desired distance. Preferably, the dust preventing member 160 is integrally formed with the inner grill 156.

Meanwhile, it is preferred that the paths 153 and 158 of the outer and inner grills 151 and 156 are defined by a plurality of path members which are disposed at an outer surface of the grill body 152 and 157 at regular intervals to be inclined at a desired angle. However, it is not limited to this condition. The paths 153 and 158 may be formed by directly punching a plurality of fine through holes in the outer surface of the grill body 151, 157. The former method is more effective in an aspect of preventing the backflow of the dust and thus mainly used.

The fine dust collecting means 170 is disposed at a downward portion of the double grill assembly 150 in the cyclone, i.e., at an inner portion of the pressure drop chamber member 121, so that the fine dust which is not separated by the double grill assembly 150 is collected once again. Therefore, the backflow of the dust by which the fine dust is exhausted together with the air to the outside is prevented, thereby increasing the dust collecting efficiency of the cyclone-type dust collecting apparatus.

The fine dust collecting means 170 is provided with a filter mounting portion 171 and a filter assembly 172. The filter mounting portion 171 is formed at an upper side of the path forming member 123 of the pressure drop chamber member 121 and has a plurality of upper and lower through holes 171*a*, 171*b* and a front opening 171*c*. The filter assembly 172 is detachably installed through the front opening 171*c* to the filter mounting portion 171 in a drawer way and also has a filter case 173 and a fine filter 174. At a portion of the filter case 173, which is contacted with an edge of the front opening, there is provided a packing member 175 for sealing. At a front face of the filter case 173, there is provided a handle 176. The fine filter 174 may be formed of sponge, nonwoven fabric, etc.

Figure 10:
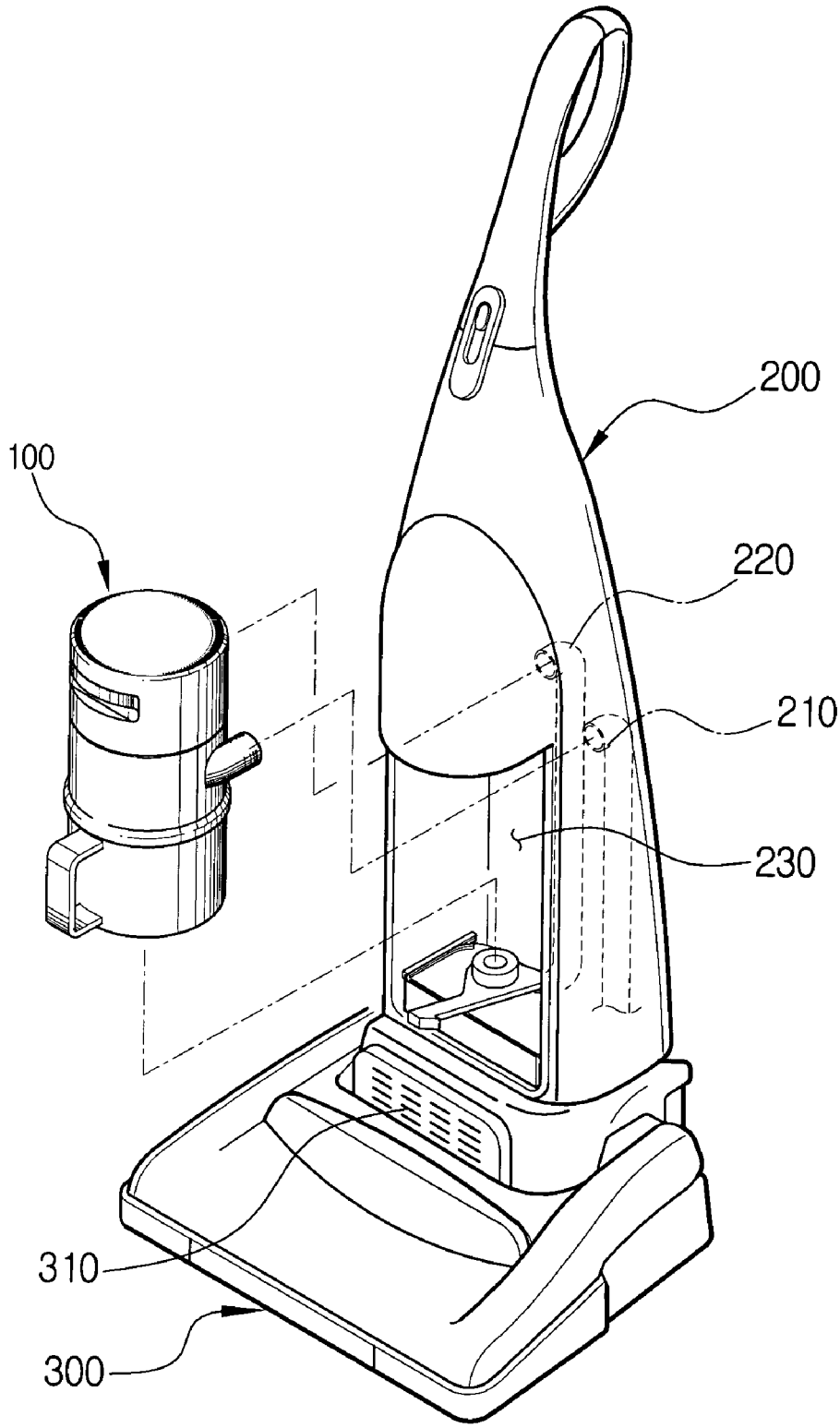
FIG. 10 is a perspective view showing a status that the cyclone-type dust collecting apparatus is mounted in the vacuum cleaner according to an embodiment of the present invention.

The above-mentioned cyclone-type dust collecting apparatus 100 for a vacuum cleaner according to an embodiment of the present invention, as shown in FIG. 10, is disposed in a dust chamber 230 of a main body of the vacuum cleaner so that the air inlet port 112 and the air outlet port 122 of the cyclone body 110 are respectively connected to an air inlet path 210 and an air outlet path 220 of the main body of the vacuum cleaner.

When starting a cleaning operation, a suction force is generated at a nozzle of a suction brush 300 due to driving of a motor in a motor driving chamber 310. Then, the air containing the dust on a surface of an object to be cleaned is introduced through the nozzle of the suction brush 300, the air inlet path 210 and the air inlet port 112 into the vortex current chamber member 111 of the cyclone body 110 due to the suction force. The air containing the dust, which is introduced through the air inlet port 112 to the vortex current chamber member 111, forms a vortex current having a large diameter with the outer grill 151 of the double grill assembly 150 in the center. Therefore, the comparative large dust is separated by the centrifugal force and then collected in the second dust collecting portion C2 of the dust collecting container 130. Then, the air in which the large dust is firstly collected forms the vortex current having a small diameter with the inner grill 156 of the double grill assembly 150 in the center, whereby the dust is secondly separated and then collected in the first dust collecting portion C1 of the dust collecting container 130. As described above, since the large dust and the comparative small dust is separately collected in the dust collecting container 130, that is, the large dust is collected in the second dust collecting portion C2 and the comparative small dust is collected in the first dust collecting portion C1, it is prevented that the path of the grill assembly 150 is clogged by the large dust. Further, since an intensity of the vortex current in the first dust collecting portion C1 for collecting the small dust is weakened, the ascending of the dust is prevented, thereby effectively collecting the dust.

The air in which the dust is separated as described above is introduced through the paths 153 and 158 of the grill assembly 150 and the communicating hole 113 into the pressure drop chamber member 121. Herein, the air which is introduced in the pressure drop chamber member 121 contains the fine dust. As shown in FIGS. 5 and 6, the dust containing the fine dust is flown in an arrow direction along the air outlet guiding path 123*a* formed in the pressure drop chamber member, and then exhausted through the upstream of the fine dust collecting means 170, the downstream of the fine dust collecting means 170 and the air outlet port 122 to the outside. The fine dust contained in the air is filtered and collected by the fine filter 174 of the fine dust collecting means 170, while passing through the fine dust collecting means 170. Only the clean air is exhausted through the air outlet port 122. Herein, the fine dust collected by the fine dust collecting means 170 exists in the upper side of the fine dust collecting means 170 due to the structure of the air outlet guiding path 123*a*. Therefore, it is each to remove the collected fine dust without drop of the dust on the floor.

Meanwhile, the purified air exhausted through the air outlet port 122 is finally exhausted through the air outlet path 220 and the motor driving chamber 310 of the main body 200 of the vacuum cleaner to the outside.

According to the present invention as described above, since the dust is separately collected in the dust collecting container according to its size, clogging of the path of the grill by the large dust and also the ascending of the small dust are prevented, so that the dust can be collected effectively.

Furthermore, since the fine dust contained in the air is filtered and collected by the fine filter which is disposed at the downstream of the grill, exhaustion of the fine dust together with the air to the outside is prevented, and as a result, the dust collecting and cleaning efficiency of the vacuum cleaner is improved.

Further, since the cyclone-type dust collecting apparatus of the present invention has a structure that the air passes from an upper portion of the fine filter toward a lower portion of the fine filter, and thus the fine dust is existed in the upper side of the fine filter, the fine dust can be removed very effectively.

That is, according to the cyclone-type dust collecting apparatus of the present invention, it is possible to provide a satisfactory vacuum cleaner in an aspect of a customer's preference, thereby increasing a comparativeness of the product.

While the present invention has been described in detail, it should be understood that various changes, substitutions and alterations can be made hereto without departing from the spirit and scope of the invention as defined by the appended claims.

What is claimed is:

1. A cyclone-type dust collecting apparatus for a vacuum cleaner, comprising:

a cyclone body having an air inlet port and an air outlet port, for forming a vortex current of air which contains dust and is introduced through the air inlet portt;

a dust collecting container removably coupled to the cyclone body so as to collect the dust separated by a centrifugal force of the vortex current in the cyclone body;

a double grill assembly disposed at an upstream portion of the air outlet port in the cyclone body to prevent dust separated from the air from flowing back through the air outlet port, and having a dual structure comprising an outer grill and an inner grill; and a fine dust collecting means disposed at a downstream portion of the double grill assembly in the cyclone body to collect fine dust which is not removed by the double grill assembly.

2. The apparatus of claim 1, wherein the cyclone body comprises a vortex current chamber member having the air inlet port at an outer surface thereof and a communicating hole at an upper surface thereof; and a pressure drop chamber member coupled to the vortex current chamber member in fluid communication through the communicating hole and having the air outlet port at an outer surface thereof, and wherein the double grill assembly is disposed at the vortex current chamber member, and fine dust collecting means is disposed at the pressure drop chamber member.

3. The apparatus of claim 2, wherein the pressure drop chamber member comprises a path forming member partitioning an inner space of the pressure drop chamber member into a first space in fluid communication with the communicating hole and a second space in fluid communication with the air outlet port, so that the air containing the fine dust passing through the double grill assembly is flown from the upstream portion toward the downstream portion of the fine dust collecting means and exhausted through the air outlet port.

4. The apparatus of claim 3, wherein the fine dust collecting means comprises a filter mounting portion formed at an upper side of the path forming member and having a front opening and a plurality of upper and lower through holes for fluidly communicating the air outlet guiding path and the air outlet port; and a filter assembly detachably coupled to the filter mounting portion in a drawer way.

5. The apparatus of claim 4, wherein the filter assembly comprises a filter case having a shape corresponding to a size and a structure of the filter mounting portion; and a fine filter disposed at the filter case.

6. The apparatus of claim 5, wherein the fine filter is formed of sponge.

7. The apparatus of claim 4, further comprising a packing member disposed at a portion of the filter case, which is contacted with an edge of the front opening.

8. The apparatus of claim 4, further comprising a handle provided at a front face of the filter case.

9. The apparatus of claim 2, wherein the outer grill and the inner grill are respectively provided with a cylindrical grill body and a plurality paths formed at an outer surface of the cylindrical grill body to be fluidly communicated with the communicating hole, and a dust preventing member is disposed at a lower side of the inner grill.

10. The apparatus of claim 9, wherein the paths are defined by a plurality of path members which are disposed at an outer surface of the grill body at regular intervals to be inclined at a desired angle.

11. The apparatus of claim 9, wherein the dust preventing member has a conical portion that is spread downward from a lower end of the grill body at a desired angle end a cylindrical portion that is extended downward from the conical portion at a desired distance.

12. The apparatus of claim 11, wherein the dust preventing member is integrally formed with the grill body.

13. The apparatus of claim 1, wherein the dust collecting container has a dual structure comprising an outer cylinder which has the same diameter as that of the cyclone body and an inner cylinder which has the same diameter as that of the outer grill, and thus is partitioned into a first dust collecting portion and a second dust collecting portion, and at least one dust outlet path for exhausting the dust of the first dust collecting portion to a second dust collecting portion is formed at a lower side of the inner cylinder.

14. The apparatus of claim 13, wherein a pair of the dust outlet paths are provided to be opposite to each other.

15. A vacuum cleaner, comprising:

a suction brush having a nozzle opened toward an surface to be cleaned and a motor driving chamber in which a motor for generating a suction force in the nozzle is mounted;

a main body of the vacuum cleaner, which is rotatably connected to the suction brush and has an air outlet path and an air inlet path connected to the motor driving chamber; and a cyclone-type dust collecting apparatus removably disposed in a dust chamber of the main body, for separately collecting dust contained in air introduced through the nozzle of the suction brush, wherein the cyclone-type dust collecting apparatus comprises a cyclone body having an air inlet port connected to the air inlet path and an air outlet port connected to the air outlet path and forming a vortex current of the air containing the dust introduced through the air inlet port; a dust collecting container removably coupled to the cyclone body so as to collect the dust separated by centrifugal force of the vortex current in the cyclone body; a double grill assembly disposed at an upstream portion of the air outlet port in the cyclone body to prevent dust separated from the air from flowing back through the air outlet port, and having a dual structure comprising an outer grill and an inner grill; and a fine dust collecting means disposed at a downstream portion of the double grill assembly in the cyclone body to collect fine dust which is not removed by the double grill assembly.

16. The cleaner of claim 15, wherein the cyclone body comprises a vortex current chamber member that the air inlet port is formed at an outer surface thereof and a communicating hole is formed at an upper surface thereof; and a pressure drop chamber member coupled to the vortex current chamber member in fluid communication through the communicating hole and having the air outlet port at an outer surface thereof, and wherein the double grill assembly is disposed at the vortex current chamber member, and the fine dust collecting means is disposed at the pressure drop chamber member.

17. The cleaner of claim 16, wherein the pressure drop chamber member comprises a path forming member partitioning an inner space of the pressure drop chamber member into a first space in fluid communication with the communicating hole and a second space in fluid communication with the air outlet port, so that the air containing the fine dust passing through the double grill assembly is flown from the upstream portion toward the downstream portion of the fine dust collecting means and exhausted through the air outlet port.

18. The cleaner of claim 17, wherein the fine dust collecting means comprises a filter mounting portion formed at an upper side of the path forming member and having a front opening and a plurality of upper and lower through holes for fluidly communicating the air outlet guiding path and the air outlet port; and a filter assembly detachably coupled to the filter mounting portion in a drawer way.

19. The cleaner of claim 18, wherein the filter assembly comprises a filter case having a shape corresponding to a size and a structure of the filter mounting portion; and a fine filter disposed at the filter case.

20. The cleaner of claim 19, wherein the fine filter is formed of sponge.

21. The cleaner of claim 19, further comprising a packing member disposed at a portion of the filter case, which is contacted with an edge of the front opening.

22. The cleaner of claim 19, further comprising a handle provided at a front face of the filter case.

23. The cleaner of claim 17, wherein the outer grill and the inner grill are respectively provided with a cylindrical grill body and a plurality paths formed at an outer surface of the cylindrical grill body to be in fluid communication with the communicating hole, and a dust preventing member is disposed at a lower side of the inner grill.

24. The cleaner of claim 23, wherein the paths are defined by a plurality of path members which are disposed at an outer surface of the grill body at regular intervals to be inclined at a desired angle.

25. The cleaner of claim 23, wherein the dust preventing member has a conical portion that is spread downward from a lower end of the grill body at a desired angle and a cylindrical portion that is extended downward from the conical portion at a desired distance.

26. The cleaner of claim 25, wherein the dust preventing member is integrally formed with the grill body.

27. The cleaner of claim 15, wherein the dust collecting container has a dual structure comprising an outer cylinder which has the same diameter as that of the cyclone body and an inner cylinder which has the same diameter as that of the outer grill, and thus is partitioned into a first dust collecting portion and a second dust collecting portion, and at least one dust outlet path for exhausting the dust of the first dust collecting portion to a second dust collecting portion is formed at a lower side of the inner cylinder.

28. The cleaner of claim 27, wherein a pair of the dust outlet paths are provided to be opposite to each other.

* * * * *